United States Patent [19]

Mori et al.

[11] 4,445,113

[45] Apr. 24, 1984

[54] SMALL TYPE ACOUSTIC DEVICE

[75] Inventors: Shigeo Mori; Fumikazu Murakami; Yoshiaki Hara; Ichiro Horikoshi; Susumu Fujita, all of Tokyo, Japan

[73] Assignee: Seiko Instruments & Electronics Ltd., Tokyo, Japan

[21] Appl. No.: 311,559

[22] Filed: Oct. 15, 1981

Related U.S. Application Data

[63] Continuation of Ser. No. 191,409, Sep. 29, 1980, abandoned, which is a continuation of Ser. No. 973,955, Dec. 28, 1978, abandoned.

[30] Foreign Application Priority Data

Dec. 30, 1977 [JP] Japan ..... 52-160385

[51] Int. Cl.[3] ..... G08B 3/00

[52] U.S. Cl. ..... 340/384 R; 340/387; 368/255

[58] Field of Search ..... 340/384 R, 388, 387; 368/255

[56] References Cited

U.S. PATENT DOCUMENTS

| | | | |
|---|---|---|---|
| 3,777,472 | 12/1973 | Iinuma | 58/57.5 |
| 3,879,931 | 4/1975 | Yasuda et al. | 58/57.5 |
| 3,931,549 | 1/1976 | Berns | 340/384 E |
| 4,159,472 | 6/1979 | Murakami et al. | 340/384 R |
| 4,183,017 | 1/1980 | Sims | 340/384 R |

*Primary Examiner*—Glen R. Swann, III

*Attorney, Agent, or Firm*—Robert E. Burns; Emmanuel J. Lobato; Bruce L. Adams

[57] ABSTRACT

A small acoustic device is provided with a housing, a first electrically actuated vibrating plate and a second vibrating plate. A support member cooperates with the housing for mounting the periphery of the second vibrating plate to the housing to define therewith an airtight chamber. The support member also supports the periphery of the first vibrating plate in the airtight chamber with a gap between the two vibrating plates and air chambers on either side of the second vibrating plate. In this way, the barometric pressure in the two air chambers on either side of the second vibrating plate are equivalent and the device is both waterproof and independent of ambient temperature changes.

8 Claims, 7 Drawing Figures

SMALL TYPE ACOUSTIC DEVICE

CROSS REFERENCE TO RELATED APPLICATIONS

This is a continuation of application Ser. No. 191,409 filed on Sept. 29, 1980, now abandoned which in turn, is a Rule 60 Continuation of grandparent application Ser. No. 973,955, filed Dec. 28, 1978, now abandoned.

BACKGROUND OF THE INVENTION

The present invention relates to a small type or miniature acoustic device having a water proof characteristic and a sound alarm function useable as a sounding member for an alarm wrist watch.

In alarm wrist watches and pocket alarms, there are many parts, i.e. a battery, a quart vibrator and an integrated circuit in which a high reliability is required. Particularly, as to a wrist watch exposed to severe conditions as is usual with such devices, it is necessary and preferable to provide a water proof characteristic for the watch case to maintain the reliability of the very important parts and to shut it off from outside air, therefore, a water proofed watch case is generally employed.

In the case of an alarm wrist watch, there is the problem of the watch case providing a water proof characteristic for said watch case, i.e. said watch case has a hermetic characteristic whereby a pressure difference between the outer barometric pressure and the pressure in said watch case is caused by a temperature irregularity.

FIG. 1 shows a conventional embodiment in which a sound member is mounted to a watch case, and wherein an electro-magnetic buzzer is employed as the sound member. In FIG. 1, numeral 1 is a magnetic core which is composed of a soft magnetic material, numeral 2 is a plate which is composed of the same material of that as said core 1, numeral 3 is a coil which is wound around said core 1, numeral 4 is a magnet, numeral 5 is a vibrating plate, numeral 6 is an upper yoke which is composed of a soft magnetic material, and said upper yoke is connected to said vibrating plate 5 by welding means.

Numeral 7 is a supporting member of the vibrating plate 5, numeral 8 is a watch case, numeral 9 is a packing member for water proofing.

As to a water proof construction relating to a sounding member of a watch case, as shown in FIG. 1, the packing member 9 is mounted between the vibrating plate 5 and watch case 8, said packing member 9 is pressed by a screw bolt 7*a* which is located in a peripheral portion of the supporting member 7 and a screw bolt 8*a* which is located in a watch case 8. The upper yoke 6 is, in the case of a non water-proof construction, generally located in the opposite portion of the magnetic core 1 against the vibrating plate 5. However, the yoke 6 has a problem for corrosion resistance since it is comprised of annealed magnetic material and therefore the yoke 6 is located so as to not directly contact outer air, further the vibrating plate 5 is generally composed of a material having a high corrosion resistance such as a stainless steel.

The above noted construction of a buzzer is well known and a detailed description of said problem in the above noted construction of the sounding member will now be given.

FIG. 2 shows a change of resonance frequency of the electromagnetic buzzer in FIG. 1 according to temperature variations, a dotted line "A" shows the characteristic in the case of a non-hermetic condition of a watch case, and the solid line "B" shows the characteristic in the case of a hermetic condition of a watch case. In the case of the dotted line "A" in FIG. 2, the resonance frequency curve has a little inclination in the negative direction, however, the above noted condition is generally caused by several factors including Young's modulus, and the magnetic characteristic and temperature characteristic of the magnet. On the contrary, in the case of the line "B" in FIG. 2, there is a large change of the resonance frequency, and such a large change presents a serious problem in the case of a hermitcally sealed watch case. This is caused by a pressure difference between inner pressure and outer barometric pressure, since the pressure in a watch case is changed by temperature according to an expression "P/T=constant" and the pressure is directly applied to the vibrating plate 5. In the above noted expression, "p" is pressure and "T" is absolute temperature. In a watch, such a pressure difference is about 0.23 barometric pressure in the range −10° C.−+60° C., i.e., the guaranteed range of operational temperature of a normal wrist watch. It will be understood that the resonance frequency is greatly changed by a small change of the gap between the core 1 and the upper yoke 6 and by a change of the vibrating plate 5 due to the pressure difference since the vibrating plate 5 is very thin, such as 0.05 cm. Further the above noted problem is similarly caused in a piezo electric type buzzer.

In a small type acoustic device, the buzzer and timepiece functions are operated by a small battery, thereby it is necessary to keep a high electro-acoustic transducing efficiency of the buzzer as an alarm function and for this purpose the resonance of the buzzer is generally employed.

However, with a change of the resonance frequency due to changes in temperature, a sufficient sound pressure is not produced when there is both a change of the resonance frequency of the buzzer and a change of the outer barometric pressure, and therefore one is not able to obtain an alarm function.

SUMMARY OF THE INVENTION

The present invention aims to eliminate the above noted difficulty and insufficiency and to provide a sounding member which consistently generates an alarm sound in the presence of normal environmental changes even if a water proof construction is employed.

DETAILED DESCRIPTION OF THE INVENTION

Figure 3:
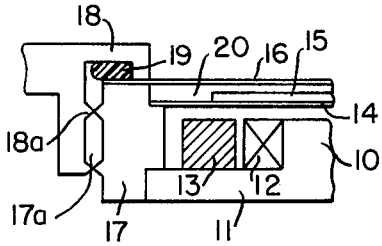
FIG. 3 is a cross sectional view of an electro-magnetic buzzer of the present invention which is mounted to a watch case.

FIG. 3 shows a cross sectional view of one embodiment of the present invention, including sounding means comprising an electro-mechanical buzzer which is mounted to a watch case.

Numeral 10 is a magnetic core, numeral 11 is a plate, numeral 12 is a coil, numeral 13 is a magnet, numeral 14 is a first vibrating plate, numeral 15 is an upper yoke which is completely contacted to the first vibrating plate 14 so as to be one body.

Figure 1:
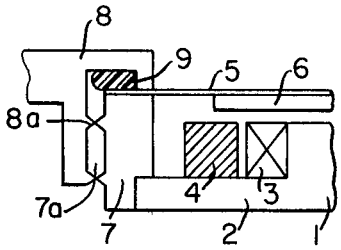
FIG. 1 PRIOR ART
FIG. 1 is a cross sectional view of a conventional electro-magnetic buzzer which is mounted to a watch case.
Figure 2:
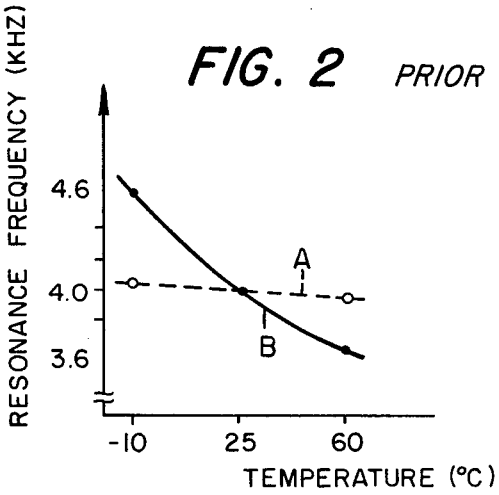
FIG. 2 PRIOR ART
FIG. 2 shows a temperature characteristic of resonance frequency of a conventional electro-magnetic buzzer.

Numeral 16 is a second vibrating plate, numeral 17 is a supporting member for the vibrating plates, numeral 18 is a watch case, numeral 19 is a sealing member, and numeral 20 is a cavity or airtight chamber formed between the plates 16 and 17. The first point which differs from the conventional construction shown in FIG. 1 is the use of the first vibrating plate 14 which receives the magnetic driving power and, using the second vibrating plate 16 which is opposed to said first vibrating plate 14, and obtaining a water proof characteristic by the packing member 19 which is disposed on a peripheral portion of said second vibrating plate 16.

Further there is the very important point, that is, the second vibrating plate 16 is not directly mechanically contacted to the first vibrating plate 14 having the upper yoke 15, and there is an airtight cavity 20 between said first and second vibrating plates 14 and 16.

Furthermore, there is the very important point, which is not clearly visible in FIG. 3, that the peripheral portion of the first vibrating plate 14 is only mounted on a peripheral portion of the supporting member 17, so that the peripheral portion of the first vibrating plate 14 is also supported by a static magnetic force of the magnet 13. In FIG. 3, the location of the upper yoke 15 differs from the location in FIG. 1, i.e. said yoke 15 is located on the opposite side of the core 10 against the vibrating plate 14, however one is able to locate said yoke 15 on the side of the core 10.

Figure 4:
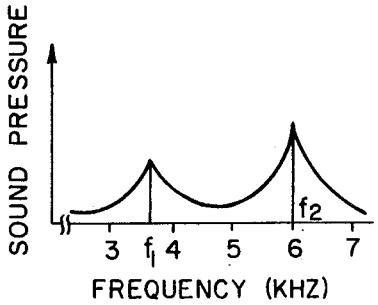
FIG. 4 shows a characteristic of a sound pressure and frequency of the buzzer of FIG. 3.

In the relation between the sound pressure and frequency of the electro-magnetic buzzer in FIG. 3, there are two resonance points as shown in FIG. 4. Namely, the electro-magnetic buzzer in FIG. 1 has a vibration of one degree of freedom, whereas the electro-magnetic buzzer in FIG. 3 has a vibration of two degrees of freedom.

Figure 5:
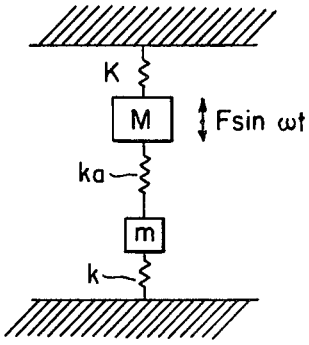
FIG. 5 is an explanatory diagram of the vibrating system of the electro-magnetic buzzer of FIG. 3.

A simplified construction of a vibration system of the electro-mechanical buzzer in FIG. 3 is shown in FIG. 5. In FIG. 5, "M" and "K" are a mass and spring constant as a vibration constant of the first vibrating plate 14 having the yoke 15, "m" and "k" are a mass and spring constant as a vibration constant of the second vibrating plate 16. "ka" is a vibration constant resulting from the air vibration characteristic of air gap 20 in FIG. 3, i.e. as a vibrating system, the mass "M" of the first vibrating plate 14 and the mass "m" are connected respectively by air spring "ka" of said air gap 20. "F sin W t" is a vibrating force which is applied to the mass "M" of the first vibrating plate 14 and is shown as an alternating force which is applied to said vibrating plate 14 when alternating current is applied to a coil. It is apparent from FIG. 5, this vibrating system is composed of two degrees of freedom, i.e. said vibrating system has two resonance points.

In FIG. 5, attenuation in said vibrating system is neglected so as to simplify the explanation. However, in the case of considering attenuation in said vibrating system, the amplitude of the first and second vibrating plates in a resonance point are limited, a sound pressure which is determined by an amplitude of the second vibrating plate is limited, i.e. a relation between an acoustic pressure and driving frequency as indicated in FIG. 4 is obtained.

Figure 6:
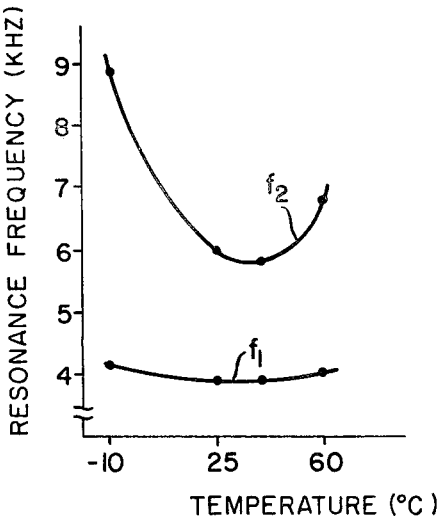
FIG. 6 shows a temperature characteristic of resonance frequency of the electro-magnetic buzzer of FIG. 3.

FIG. 6 shows the relation between the temperature vs. resonance frequency of an electro-magnetic type buzzer according to the embodiment shown in FIG. 3. In FIG. 6, the data for the curves was measured under a condition such that there existed a pressure different in or out of the watch case according to a temperature in the case under a non-airproof condition of said watch case. Lines "f1" and "f2" show two resonance frequencies in FIG. 4, said "f1" is a low resonance, "f2" is a high resonance frequency. As shown in FIG. 6, the frequency of said high resonance frequency "f2" is greatly changed whereas the frequency of said low resonance frequency is almost constant.

Referring now to the principle of said high and low resonance frequencies:

First of all, referring to the earlier explanation, in the vibrating system of FIG. 5, two resonance frequencies are obtained by the formula (1) as follows:

$$W^4-(Wa^2+Wb^2)W^2+(Wa^2-Wab^4)=0 \quad (1)$$

W is an angular frequency, relation to a frequency "f" is "$W=2\pi f$.

$$Wa^2=\frac{K+Ka}{M}\quad Wb^2=\sqrt{\frac{K+Ka}{M}}\quad Wab^4=\sqrt{\frac{Ka^2}{M\cdot m}}$$

according to a formula (1), two angular frequencies $W_1$ and $W_2$ in the two resonance points are obtained by the following formula, $$W_1^2,\ W_2^2=\tfrac{1}{2}\{(Wa^2+Wb^2)\pm\sqrt{(Wa^2-Wb^2)+4Wab^2}\}$$

In the above noted formula, in case of the electro-magnetic type buzzer in FIG. 3, $Wb^2>Wa^2$ in the case of employing a selected dimension and material, further $(Wb^2-Wa^2)^2>>4Wab^4$. In this case, $$W_1^2\approx Wa^2-\frac{Wab^4}{Wb^2-Wa^2}$$

$$W_2^2\approx Wb^2+\frac{Wab^4}{Wb^2-Wa^2}.$$

Namely, the low resonance frequency "f1" is determined by "M" and "K" which are the vibration constants of the first vibrating plate 14 and the spring constant "ka" of the air gap 20, on the other hand, the high resonance frequency "f2" is determined by "m" and "k" which are the vibration constants of the second vibration plate 16 and the spring constant "ka" of the air gap 20. However, both of the low and high resonance frequencies "f1" and "f2" have $$\frac{Wab^4}{Wb^2-Wa^2}$$

whereby the low resonance frequency "f1" receives the influence of the vibration constant of the second vibrating plate 16, further the high resonance frequency "f2" receives the influence of the vibration constant of the first vibrating plate.

As can be seen in FIG. 3, when a pressure difference results between the inner and outer portions of the watch case 18, said pressure difference is only applied to the second vibrating plate 16 since the peripheral portion of said second vibrating plate 16 is kept in an airproof condition thereby isolating the first vibrating plate 14 from the effects of the pressure difference. Further the peripheral portion of the first vibrating plate 14 is merely positioned on the supporting member for the vibrating plate, therefore, the pressure difference does not exist in the airtight chamber at the front portion and back portion of the vibrating plate 14. Thus, if there is a change of the vibrating constant according to a deformation of the second vibrating plate 16, a pressure difference is not applied to the first vibrating plate 14, and as no result, a deformation of the first vibrating plate 14 and no change of the gap spacing between the core 10 and the first vibrating plate 14 due to such deformation of the second vibrating plate 16 occurs and thus there is no change of the vibrating constant of the first vibrating plate 14. A change of the vibrating constant which is caused by the deformation of the second vibrating plate 16 is almost caused by the change of the spring constant, i.e. said spring constant becomes larger than a non-pressure difference condition.

According to a change of the vibrating constant of the second vibrating plate 16, the high resonance frequency "f2" is greatly changed, further, the low resonance frequency "f1" is hardly affected by the change of the vibrating constant of the second vibrating plate 16. According to the pressure difference, the above noted low and high resonance frequencies "f1" and "f2" are changed to a higher zone than in the case of a non-pressure difference condition. The above noted description is the reason for which a temperature characteristic of the electro-magnetic buzzer of the present invention in FIG. 3 exhibits the characteristic shown in FIG. 6. Therefore, one is able to efficiently obtain a constant alarm sound pressure and to constantly use a point near the resonance point "f1" in spite of a change of condition by setting the low resonance frequency having little change according to a pressure difference to the near position of the driving frequency of the alarm buzzer. Thus according to the present invention, one is able to efficiently obtain a constant alarm sound pressure by using a construction of a sound as shown in FIG. 3 and using the low resonance frequency.

Figure 7:
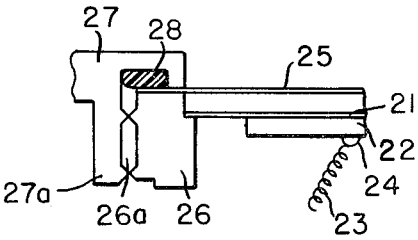
FIG. 7 is a cross sectional view of another embodiment of a piezoelectric buzzer of the present invention which is mounted to a watch case.

We referred to the electro-magnetic buzzer in the above noted embodiment of the present invention, however, one is able to obtain the same performance by using a piezo-electric type buzzer, and FIG. 7 shows another embodiment of the invention using a piezo-electric type buzzer. In FIG. 7, numeral 21 shows the first vibrating plate, numeral 22 shows the piezo-electric element, numeral 23 shows a lead wire, numeral 24 shows a solder, said lead wire 23 is connected to one electrode of said piezo-electric element 22.

Numeral 25 shows the second vibrating plate, numeral 26 shows the supporting member for vibrating plate, numeral 27 shows the watch case, numeral 28 shows the water proof type packing. As to the construction, the first vibrating plate 14 having the upper yoke 15 in FIG. 3 is transferred to the first vibrating plate 21 having a piezo-electric element 22. The core 10, the plate 11, the coil 12 and the core 13 are omitted.

The piezo-electric buzzer vibrating system has the same construction shown in FIG. 5 for the electro-magnetic buzzer. In the electro-magnetic buzzer, the peripheral portion of the first vibrating plate 14 is only positioned on the supporting member 17, and the the hermetic condition of the air cavity is shortly kept during the vibrating operation, and it is designed so as to not cause a pressure difference between a front and back portions of the first vibrating plate 14. Therefore, as to a piezo-electric buzzer, the above noted same condition is required. One is not able to constantly obtain a buzzer performance in an irregular environment without a care or consideration of the above noted construction of the present invention.

FIG. 7 shows one way of satisfying such a requirement, and there are several ways for satisfying the requirement as follows:

As a first way, a supporting portion of the peripheral portion of the first vibrating plate 21 is partially adhered. As a second way, a pin hole is shaped at one part of the first vibrating plate 21 or the supporting member 26. As another way, one can employ a material having the same permeability as the first vibrating plate. It is not so difficult to use a single way or combimed ways of the above noted several ways.

The above noted ways are able to use the electro-magnetic buzzer according to the condition of the first vibrating plate 14.

According to the present invention, in the case of the small acoustic device in which a high reliability is required, it is possible to constantly obtain the acoustic performance without connection with a change of environment.

We claim:

1. In a small type acoustic device having a housing, a first vibrating plate electrically actuatable as a vibrating element of a sound generator, and driving means for electrically actuating the first vibrating plate at a selected driving frequency, the improvement comprising: a second vibrating plate; means mounting the second vibrating plate on the housing including water-proofing means disposed between the housing and one surface of the second vibrating plate to form an airtight chamber with said one surface of the second vibrating plate exposed to the atmosphere; and means mounting the first vibrating plate in the airtight chamber to form a first air chamber between the two vibrating plates and a second air chamber including therein a portion of said driving means; and wherein the selected driving frequency of the driving means is substantially equal to the resonant frequency of the first vibrating plate, whereby the sound pressure of the acoustic device is independent of temperature change.

2. The device according to claim 1, wherein the water-proofing means comprises a packing.

3. The device according to either of claims 1 or 2, wherein the housing comprises a timepiece case.

4. A miniature acoustic device comprising: a housing; a first electrically actuatable vibrating plate; a second vibrating plate; and supporting means coactive with the housing for mounting the periphery of the second vibrating plate to the housing to define an airtight chamber with one surface of the second vibrating plate exposed to the atmosphere and the opposite surface of the second vibrating plate forming part of the airtight chamber and for supporting the periphery of the first vibrating plate in the airtight chamber spaced apart from the second vibrating plate with air chambers on either side of the first vibrating plate.

5. The device according to claim 4, further including water-proofing means disposed between the housing and the periphery of the second vibrating plate.

6. The device according to either of claims 4 or 5, wherein the housing comprises a timepiece case.

7. The device according to claim 4; wherein the first and second vibrating plates have a different resonant frequency; and further including driving means for electrically actuating the first vibrating plate at a driving frequency substantially equal to the resonant frequency of the first vibrating plate to produce a sound pressure output which is independent of temperature variations.

8. The device according to claim 7; wherein the resonant frequency of the first vibrating plate is lower than that of the second vibrating plate.

* * * * *